US008459870B2

(12) United States Patent
Katada et al.

(10) Patent No.: US 8,459,870 B2
(45) Date of Patent: Jun. 11, 2013

(54) INTERLOCKING DEVICE AND PACKAGING BAG WITH INTERLOCKING DEVICE

(75) Inventors: Ryo Katada, Chiba (JP); Hiroko Shioda, Chiba (JP); Kenichi Tanaka, Chiba (JP)

(73) Assignee: Idemitsu Unitech Co., Ltd., Tokyo (JP)

( * ) Notice: Subject to any disclaimer, the term of this patent is extended or adjusted under 35 U.S.C. 154(b) by 386 days.

(21) Appl. No.: 12/738,875

(22) PCT Filed: Oct. 16, 2008

(86) PCT No.: PCT/JP2008/068779
§ 371 (c)(1),
(2), (4) Date: Apr. 20, 2010

(87) PCT Pub. No.: WO2009/054313
PCT Pub. Date: Apr. 30, 2009

(65) Prior Publication Data

US 2010/0220940 A1 Sep. 2, 2010

(30) Foreign Application Priority Data

Oct. 22, 2007 (JP) ..... 2007-274201

(51) Int. Cl.
*B65D 33/16* (2006.01)

(52) U.S. Cl.
USPC ..... 383/65; 383/63; 383/61.2

(58) Field of Classification Search
USPC ..... 383/61.1, 61.2, 63, 64, 65
See application file for complete search history.

(56) References Cited

U.S. PATENT DOCUMENTS 5,577,305 A * 11/1996 Johnson ..... 24/585.12
5,603,995 A * 2/1997 Takubo et al. ..... 428/34.1
5,645,905 A 7/1997 Takubo et al.

(Continued)

FOREIGN PATENT DOCUMENTS

EP 1 747 732 A1 1/2007
JP 06-191540 A 7/1994

(Continued)

OTHER PUBLICATIONS

Supplemental European Search Report, dated Nov. 10, 2011, issued in corresponding EP Application No. 08841245.7, 6 pages.

(Continued)

*Primary Examiner* — Justin Larson
*Assistant Examiner* — Peter Helvey
(74) *Attorney, Agent, or Firm* — Millen, White, Zelano, Branigan, P.C.

(57) ABSTRACT

A packaging bag has a zipper including a pair of male member and a female member that are engageable with each other. The male member includes: a belt-shaped male base element provided on a packaging bag body; and a male engaging portion projecting from the belt-shaped male base element. The female member includes: a belt-shaped female base element located at a position opposed to the belt-shaped male base element; and a female engaging portion projecting from the belt-shaped female base element, the male engaging portion and the female engaging portion being disengageably engaged to form an engaging portion. The belt-shaped male base element and the belt-shaped female base element are made of a resin of which tensile modulus of elasticity is in a range of 700 MPa to 1600 MPa. The engaging portion is made of a resin of which tensile modulus of elasticity is in a range of 110 MPa to 560 MPa.

8 Claims, 2 Drawing Sheets

U.S. PATENT DOCUMENTS

| | | | | |
|---|---|---|---|---|
| 5,729,876 | A * | 3/1998 | Johnson | 24/587.1 |
| 7,134,192 | B1 * | 11/2006 | Savicki et al. | 29/766 |
| 8,075,186 | B2 * | 12/2011 | Borchardt et al. | 383/63 |
| 2004/0136618 | A1 | 7/2004 | Ausnit et al. | |
| 2005/0063624 | A1 * | 3/2005 | Goto et al. | 383/205 |
| 2006/0008184 | A1 * | 1/2006 | Borchardt et al. | 383/63 |
| 2006/0120630 | A9 * | 6/2006 | Ausnit et al. | 383/64 |
| 2006/0171609 | A1 * | 8/2006 | Turvey et al. | 383/63 |
| 2009/0214141 | A1 * | 8/2009 | Borchardt et al. | 383/63 |
| 2009/0238500 | A1 * | 9/2009 | Nanba et al. | 383/203 |

FOREIGN PATENT DOCUMENTS

| | | | |
|---|---|---|---|
| JP | 06-191540 | W | 7/1994 |
| JP | 07-112748 | A | 5/1995 |
| JP | 07-112748 | W | 5/1995 |
| JP | 09 037815 | | 2/1997 |
| JP | 2001 307551 | | 11/2001 |
| JP | 2005-312640 | A | 11/2005 |
| JP | 2005-312640 | W | 11/2005 |
| JP | 2005-329150 | A | 12/2005 |
| JP | 2005-329150 | W | 12/2005 |
| JP | 2005-349012 | A | 12/2005 |
| JP | 2005-349012 | W | 12/2005 |
| WO | PCT/JP2008/068779 | R | 1/2009 |

OTHER PUBLICATIONS

English Translation of Office Action for related Japanese Patent Application No. 2009 538145 dated Oct. 2, 2012.

Idemitsu Petrochem Co Ltd., "Engaging element and packaging bag with engaging element," Patent Abstracts of Japan, Publication Date: Feb. 10, 1997; English Abstract of JP-09 037815.

Idemitsu Petrochem Co Ltd., "Wire coating resin composition and its manufacturing method," Patent Abstracts of Japan, Publication Date: Nov. 2, 2001; English Abstract of JP-2001 307551.

Office Action for related Japanese Patent Application No. 2009 538145 dated Oct. 2, 2012.

* cited by examiner

INTERLOCKING DEVICE AND PACKAGING BAG WITH INTERLOCKING DEVICE

TECHNICAL FIELD

The present invention relates to a zipper capable of opening and resealing, and a zipper packaging bag provided with the zipper.

BACKGROUND ART

Among packaging bags for packaging various articles such as food and medical products, a zipper packaging bag having a belt-shaped zipper at an opening of the bag, the zipper including a pair of male and female members that are engaged, the male and female members being engaged in an openable and closable manner.

In order to manufacture the zipper packaging bag, the zipper is usually prepared in advance and is thermally bonded (i.e. heat sealed) onto a base film of the packaging bag body. At this time, the resin forming the zipper is the same as a resin of an innermost layer of the base film, i.e. a sealant layer, in order to facilitate the heat-sealing with the base film. Accordingly, selection of the zipper is required according to the type of the sealant layer.

On the other hand, a chuck-tape packaging bag (zipper packaging bag) that is capable of heat-sealing a sealant layer and a chuck tape irrespective of the type of the sealant layer of the base film has come to be known in these days (see Patent Literature 1, for instance).

The chuck-tape packaging bag disclosed in Patent Literature 1 has a belt-shaped male member and a female member engaging with the male member. The male member includes a base provided to a bag body via a seal portion bonded to the bag body, a connecting portion provided on the base and a head connected to the base through the connecting portion. Similarly, the female member includes another base provided to the bag body via another seal portion bonded to the bag body and first and second hooks connected to the base.

The base, head and connecting portion of the male member are integrally provided by the resin forming the base. Similarly, the base, the first and the second hooks of the female member are integrally provided by the resin forming the base.

[Patent Literature 1] JP-A-2005-329150

DISCLOSURE OF THE INVENTION

Problems to Be Solved by the Invention

Since the same resin is used for the engaging portion and the base of the chuck-tape packaging bag of Patent Literature 1, when, for instance, the zipper in the form of the chuck tape is heat-sealed to the bag body, the base made of a resin of low tensile modulus of elasticity (e.g. Linear Low Density Polyethylene, abbreviated as "LLDPE" hereinafter) may cause seal wrinkles on the zipper on account of increase in thermal shrinkage rate. Similarly, since a resin of low tensile modulus of elasticity, which is generally low in melting point, is used for the engaging portion, the engaging portion may be thermally deformed when being heat-sealed to loosen the engagement.

When, on the other hand, the engaging portion is made of a resin of high tensile modulus of elasticity, if a packaging bag includes aluminum foil and an end of the zipper is bonded to the bag body (so-called point seal), the aluminum foil may be cracked. Further, when the base is made of a heat-resistant resin, since the bases of the male and female members are not easily completely bonded to the bag body when being point-sealed, pinholes may be generated.

In order to restrain the aluminum crack, it is generally known to ultrasonically point-seal before thermally point-sealing. However, according to the ultrasonic sealing, when the power of the ultrasonic wave is excessively raised, the surface of the engaging portion (the head of the male member and the first and second hooks of the female member) may be scraped to be scattered into particles before the bonding surface between the bases of the male and female members and the bag body is heated. Accordingly, in order not to cause aluminum crack and particle scattering, bag-making speed has to be lowered.

An object of the invention is to provide a zipper and a zipper packaging bag capable of restraining a generation of seal wrinkles and thermal deformation of the engaging portion when being heat-sealed and a generation of pinholes when being point-sealed, and preventing aluminum crack when the packaging bag body including an aluminum foil and the zipper are point-sealed.

Means for Solving the Problems

A zipper according to an aspect of the invention is provided substantially along an opening periphery of a packaging body, the zipper including: a pair of male member and a female member, the male member and the female member being engageable with each other to form an accommodating space in cooperation with the packaging bag body, the male member including a belt-shaped male base element provided on the packaging bag body adjacent to the accommodating space and a male engaging portion projecting from the belt-shaped male base element toward the accommodating space, the female member including a belt-shaped female base element located at a position opposed to the belt-shaped male base element and a female engaging portion projecting from the belt-shaped female base element, the female engaging portion disengageably engaged with the male engaging portion to form an engaging portion, the belt-shaped male base element and the belt-shaped female base element being made of a resin having a tensile modulus of elasticity in a range of 700 MPa to 1600 MPa, and the engaging portion being made of a resin having a tensile modulus of elasticity in a range of 110 MPa to 560 MPa.

According to the above arrangement, the resin forming the engaging portion has a specific range of tensile modulus of elasticity and the resin forming the belt-shaped male base element and the belt-shaped female base element also has a specific range of tensile modulus of elasticity. Accordingly, when the zipper is heat-sealed on the packaging bag body, the generation of seal wrinkles and thermal deformation of the engaging portion can be restrained. Additionally, when the zipper is point-sealed on the packaging bag body, the generation of pinholes can be restrained and, when the zipper is point-sealed on the packaging bag body including aluminum foil, aluminum crack is prevented, thus providing a zipper with excellent appearance.

When the engaging portion made of a resin with a tensile modulus of elasticity lower than 110 MPa is, for instance, heat-sealed, engagement strength is reduced so that it is difficult for the zipper to be zipped. On the other hand, when the tensile modulus of elasticity is higher than 560 MPa, when the zipper is, for instance, point-sealed on the packaging bag body including aluminum foil, a large number of aluminum cracks are generated. When a belt-shaped male base element and a belt-shaped female base element made of a resin of which tensile modulus of elasticity is lower than 700 MPa is, for instance, is heat-sealed, seal wrinkles are generated on account of thermal contraction. On the other hand, when the tensile modulus of elasticity is higher than 1600 MPa, since the belt-shaped male base element and the belt-shaped female base element are not easily bonded to the packaging bag body, pinholes are generated.

Accordingly, the tensile modulus of elasticity of the resin forming the belt-shaped male base element and the belt-shaped female base element is in a range of 700 MPa to 1600 MPa, preferably in a range of 800 MPa to 1200 MPa. The tensile modulus of elasticity of the resin forming the engaging portion is in a range of 110 MPa to 560 MPa, preferably in a range of 200 MPa to 450 MPa.

The tensile modulus of elasticity can be measured according to HS (Japanese Industrial Standard) K7127.

In the above aspect of the invention, the belt-shaped male base element and the belt-shaped female base element respectively preferably comprises a seal portion bonded to the packaging bag body, and the seal portion is preferably made of a resin containing 50 mass % to 99 mass % of metallocene linear low density polyethylene of which density is in a range of 850 kg/m$^3$ to 920 kg/m$^3$ and melt flow rate is in a range of 1.0 g/10 min to 5.0 g/10 min.

According to the above arrangement, since the seals contain the specific ratio of metallocene linear low density polyethylene having specific density and melt flow rate (sometimes referred to as "MFR" hereinafter), the seals can be suitably attached to not only to polyethylene but also to polypropylene sealant layer of the packaging bag body to which the zipper is attached, thereby providing a zipper having excellent bondability with the packaging bag body irrespective of the type of the innermost layer of the packaging bag body.

When the density of the metallocene linear low density polyethylene is lower than 850 kg/m$^3$, lubricity of the metallocene linear low density polyethylene may be deteriorated to cause an awkward slide movement of the zipper while forming a bag, thereby being unable to produce a bag. On the other hand, when the density exceeds 920 kg/m$^3$, the bonding strength of the seals against the belt-shaped male base element and belt-shaped female base element may be reduced, to deteriorate the bondability with the polypropylene sealant layer.

When MFR of the metallocene linear low density polyethylene is lower than 1.0 g/10 min, the seals may not be suitable for high-speed molding. On the other hand, when MFR exceeds 5.0 g/10 min, the bonding strength of the seals against the belt-shaped male base element and belt-shaped female base element may be reduced, to deteriorate the bondability with the polypropylene sealant layer.

When the ratio of the metallocene linear low density polyethylene is less than 50 mass %, the bondability of the seals against the sealant layer may be deteriorated, so that the seals may exhibit a bonding strength with which the seals can be manually separated even after being bonded to the sealant layer. On the other hand, when the ratio of the metallocene linear low density polyethylene exceeds 99 mass %, moldability during extrusion may be deteriorated.

Accordingly, the ratio of the metallocene linear low density polyethylene forming the seals is in a range of 50 mass % to 99 mass %, preferably in a range of 70 mass % to 99 mass %.

Further, the density of the metallocene linear low density polyethylene is in a range of 850 kg/m$^3$ to 920 kg/m$^3$, preferably in a range of 860 kg/m$^3$ to 905 kg/m$^3$.

Further MFR of the metallocene linear low density polyethylene is in a range of 1.0 g/10 min to 5.0 g/10 min, preferably in a range of 1.5 g/10 min to 4.5 g/10 min.

In the above aspect of the invention, the engaging portion is made of a resin having a melting point in a range of 115 degrees C. to 160 degrees C.

With the above arrangement, since the resin forming the engaging portion has a specific melting point, the zipper can be attached to the packaging bag body at a temperature lower than the specific melting point and thermal deformation of the engaging portion can be restrained. In the above, examples of the resin that can be employed for the male engaging portion and the female engaging portion include random propylene, homo-polypropylene, block polypropylene, metallocene linear low density polyethylene produced using a metallocene catalyst, linear ethylene-a-olefin copolymer, ethylene/polar vinyl monomer copolymer, ethylene-propylene copolymer and propylene-butene-1copolymer (referred to as PrBt1 hereinafter).

With the use of the engaging portion of which melting point is lower than 115 degrees C., the engaging portion may be thermally deformed when the zipper is heat-sealed on the packaging bag body.

On the other hand, when the melting point of the engaging portion is higher than 160 degrees C., thermal bonding between the engaging portions does not easily occur, thereby lowering the bonding strength.

Accordingly, the resin of the engaging portion is in a range of 115 degrees C. to 160 degrees C., preferably in a range of 120 degrees C. to 155 degrees C.

In the above aspect of the invention, the engaging portion preferably is made of a resin containing a modifier.

In the above, the modifier refers to low density polyethylene (abbreviated as "LDPE" hereinafter), LLDPE, polyolefin thermoplastic elastomer (Thermo-Plastic Olefin: abbreviated as "TPO" hereinafter) and the like, which reduces the tensile modulus of elasticity of the male and female engaging portions.

TPO is a copolymer of two or more olefins selected from a group of ethylene, propylene, 1-butene, linear and branched 1-olefin and the like, which is preferably amorphous in terms of high softening effect, however, may be crystalline as long as softening effect can be obtained. Examples of TPO include Prime Polypro (trade name) manufactured by Prime Polymer Co., Ltd. and Tafcelene manufactured by Sumitomo Chemical Co., Ltd.

According to the above arrangement, by adding the modifier to the engaging portion to adjust the tensile modulus of elasticity in the range of 110 MPa to 560 MPa, aluminum crack can be prevented.

The modifier is preferably a TPO, of which melting point is preferably in a range of 130 to 145 degrees C.

With the use of TPO as the modifier, when the zipper is heat-sealed on the packaging bag body having aluminum foil, thermal deformation of the engaging portion can be prevented. Further, since TPO has low tensile modulus of elasticity, aluminum crack can be favorably prevented during point-sealing.

Further, with the use of TPO as the modifier to increase the polypropylene content, scrape of the surface of the engaging portion to be scattered in particles can be prevented while the zipper is ultrasonically heated.

In the above aspect of the invention, the belt-shaped male base element and the belt-shaped female base element are preferably made of a resin containing at least one of resins selected from the group consisting of random polypropylene, block polypropylene and homo-polypropylene.

According to the above arrangement, as compared to a belt-shaped male base element and belt-shaped female base element made of LLDPE resin, generation of seal wrinkles caused when being heat-sealed can be further restrained.

Further, by forming the belt-shaped male base element and the belt-shaped female base element with random polypropylene of which tensile modulus of elasticity is higher than the resin forming the engaging portion by 270 MPa or more, aluminum crack can be further effectively prevented when the zipper is, for instance, point-sealed on the packaging bag body having aluminum foil. Further, when the belt-shaped male base element and the belt-shaped female base element are made of a resin in which homo-polypropylene and block polypropylene are mixed in random polypropylene, the aluminum crack can be prevented by setting the tensile modulus of elasticity at a level higher than the resin forming the engaging portion by 270 MPa. The tensile modulus of elasticity of the belt-shaped male base element and the belt-shaped female base element increases when homo-polypropylene and block polypropylene are contained therein.

In the above aspect of the invention, the engaging portion is preferably made of linear low density polyethylene or low density polyethylene, and the belt-shaped male base element and the belt-shaped female base element are preferably made of a resin containing at least one of resins selected from the group consisting of random polypropylene, block polypropylene and homo-polypropylene.

With the above arrangement, when the resin forming the engaging portion is not mixed with a modifier such as TPO, seal wrinkles can be restrained when the zipper is heat-sealed on the packaging bag body. Also, when the zipper is, for instance, point-sealed on the packaging bag body, generation of pinholes can be restrained. Further, when the zipper is point-sealed on the packaging bag body having aluminum foil, aluminum crack can be prevented, thus providing a zipper packaging bag with excellent appearance.

A zipper packaging bag according to another aspect of the invention includes: a packaging bag body; and the above-described zipper.

With the above arrangement, since the zipper packaging bag has the above-described zipper attached to the packaging bag body, when the zipper is, for instance, point-sealed on the packaging bag body having aluminum foil, aluminum crack and generation of pinholes can be prevented. Further, thermal deformation of the engaging portion and seal wrinkles can be restrained during heat-sealing, thereby providing a zipper packaging bag with excellent appearance.

The packaging bag body preferably includes an aluminum foil.

With the above arrangement, when the zipper is point-sealed on the packaging bag body having the aluminum foil, the zipper can be attached without generating aluminum crack on the packaging bag body.

BEST MODE FOR CARRYING OUT THE INVENTION

Exemplary embodiment(s) of the invention will be described below with reference to the attached. drawings.

In this exemplary embodiment, a zipper packaging bag according to the invention (abbreviated as "packaging bag" hereinafter) is exemplified by a packaging bag body provided with a packaging bag body and a zipper provided on the packaging bag such as a packaging bag for packaging various articles such as foods, medicines, medical products and groceries.

Figure 1:
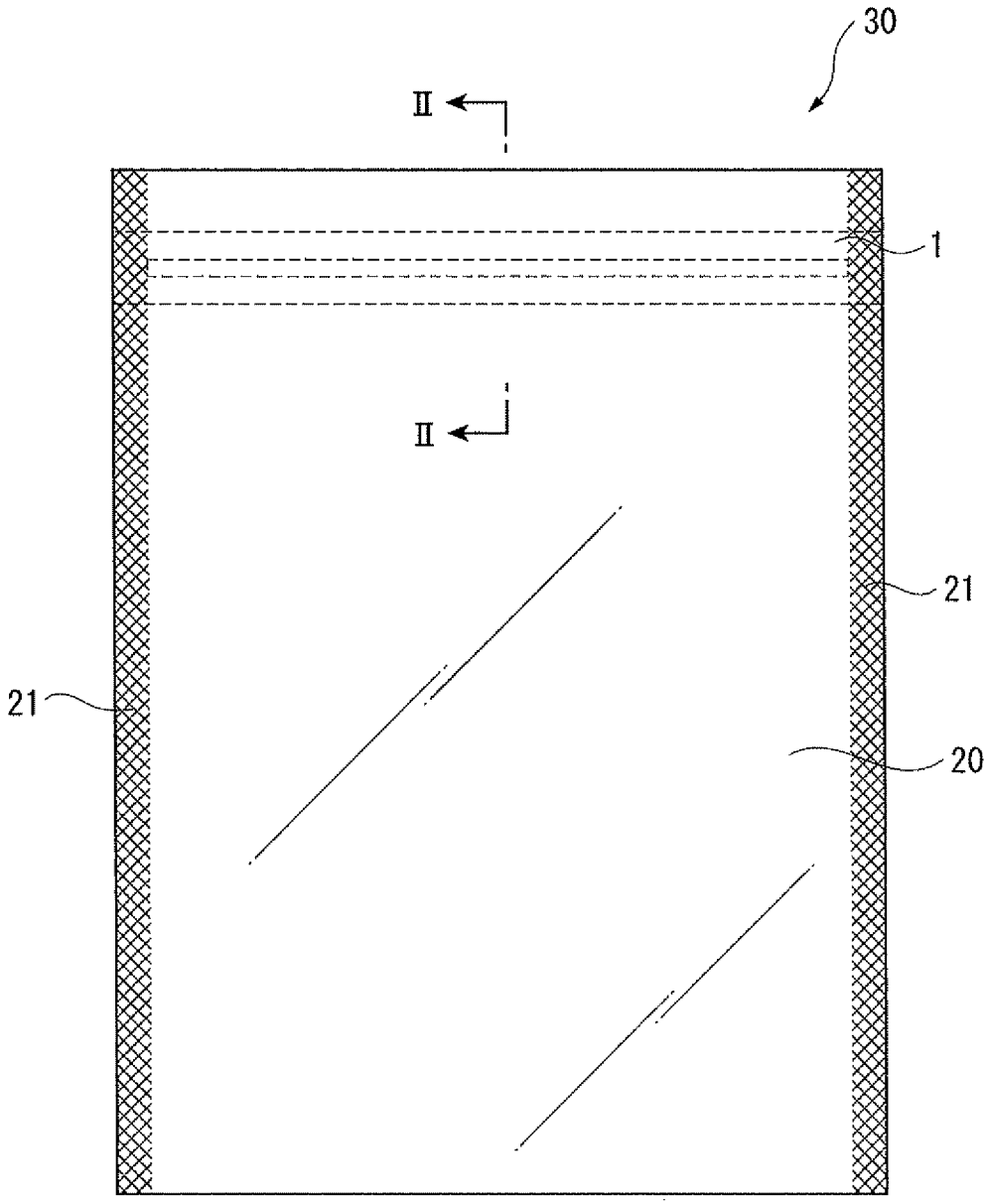
FIG. 1 is a front elevation showing a packaging bag according to an exemplary embodiment of the invention.
Figure 2:
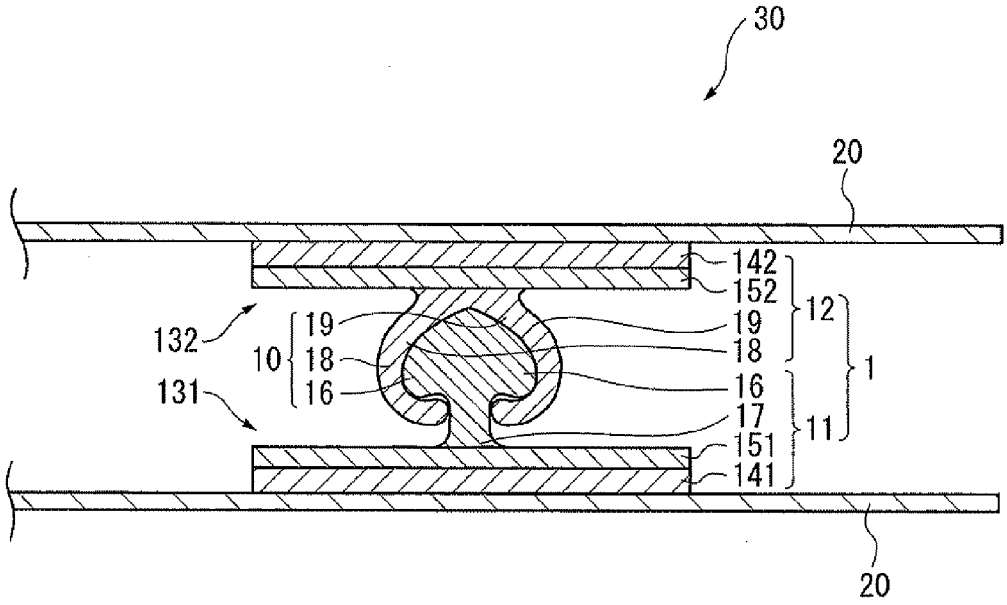
FIG. 2 is a cross section taken along II-II line in FIG. 1 showing a zipper provided on a packaging bag body.

FIG. 1 is a front elevation showing a packaging bag according to the exemplary embodiment. FIG. 2 is a cross section taken along II-II line in FIG. 1, showing a zipper of this exemplary embodiment bonded to the packaging bag body of the packaging bag.

Arrangement of Packaging Bag

As shown in FIG. 1, the packaging bag 30 includes: a substantially rectangular (in front elevation) packaging bag body 20 provided by superposing base films having aluminum foil thereinside; a side seal 21 provided on longitudinal sides of the packaging bag body 20; a belt-shaped zipper 1 provided along an opening edge of the packaging bag body 20, the zipper 1 having a mutually engageable pair of male member 11 and a female member 12; and an accommodating space defined by the zipper 1 and the packaging bag body 20 when the male member 11 and the female member 12 are engaged.

As shown in FIG. 2, the male member 11 includes a belt-shaped male base 131 provided on the packaging bag body 20 and a male engaging portion projecting from the belt-shaped male base 131. On the other hand, the female member 12 includes: a belt-shaped female base 132 provided at a position substantially opposed to the belt-shaped male base 131 and a female engaging portion projecting from the belt-shaped female base 132 and engageable with the male engaging portion.

The belt-shaped male base 131 includes a male seal 141 bonded to a sealant layer of the packaging bag body 20 and a belt-shaped male base element 151 provided between the male seal 141 and the male engaging portion. The male engaging portion includes a head 16 having substantially inverted triangle cross section and a connector 17 that connects the belt-shaped male base element 151 and the head 16.

On the other hand, the belt-shaped female base 132 includes a female seal 142 bonded to the sealant layer of the packaging bag body 20 and a belt-shaped female base element 152 provided between the female seal 142 and the female engaging portion. The female engaging portion includes a first hook 18 and a second hook 19 opposed to the first hook 18.

The head 16 and the connector 17 of the male engaging portion and the first and second hooks 18 and 19 of the female engaging portion are engaged to form an engaging portion 10.

The engaging portion 10 is made of random polypropylene containing TPO (modifier), of which tensile modulus of elasticity is in a range of 110 MPa to 560 MPa and of which melting point is in a range of 115 degrees C. to 160 degrees C. The modifier may alternatively be LDPE, LLDPE, EPR, EPDM, PtBt1 and the like instead of TPO.

When the tensile modulus of elasticity of the resin forming the engaging portion 10 is lower than 110 MPa, the engagement strength of the head 16 and the connector 17 in relation to the first hook 18 and the second hook 19 of the female engaging portion is lowered. On the other hand, when the tensile modulus of elasticity of the resin of the engaging portion 10 is higher than 560 MPa, when the zipper 1 is point-sealed on the packaging bag body 20, a large number of aluminum cracks are generated.

With the use of the engaging portion 10 of which melting point is lower than 115 degrees C., the engaging portion 10 may be thermally deformed when the zipper 1 is heat-sealed on the packaging bag body 20. On the other hand, when the melting point of the engaging portion 10 is higher than 160 degrees C., the engaging portions are not mutually thermally bonded during the point-sealing, thereby lowering the bonding strength.

The belt-shaped male base element 151 and the belt-shaped female base element 152 have a tensile modulus of elasticity in a range of 700 MPa to 1600 MPa and are made of a random polypropylene or a random polypropylene containing a modifier. The modifier is a resin such as homo-polypropylene and block polypropylene.

When the tensile modulus of elasticity of the resin forming the belt-shaped male base element 151 and the belt-shaped female base element 152 is lower than 700 MPa, seal wrinkles may be generated on account of thermal contraction during the heat-sealing. On the other hand, when the tensile modulus of elasticity of the resin forming the belt-shaped male base element 151 and the belt-shaped female base element 152 is higher than 1600 MPa, the belt-shaped male base 131 and the belt-shaped female base 132 may not be easily thermally bonded during the point-sealing, thereby generating pinholes.

The male seal 141 and the female seal 142 are made of a resin containing 50 mass % to 99 mass % of metallocene linear low density polyethylene of which density is in a range of 850 kg/m$^3$ to 920 kg/m$^3$ and MFR is in a range of 1.0 g/10 min to 5.0 g/10 min.

When the density of the metallocene linear low density polyethylene is lower than 850 kg/m$^3$, lubricity of the metallocene linear low density polyethylene may be deteriorated to cause an awkward slide movement of the zipper while forming a bag, thereby being unable to produce a bag. On the other hand, when the density exceeds 920 kg/m$^3$, the bonding strength between the male seal 141 and the belt-shaped male base element 151 and between the female seal 142 and the belt-shaped female base element 152 may be decreased and bondability between the seals and the polypropylene sealant layers may be deteriorated.

When MFR of the metallocene linear low density polyethylene is lower than 1.0 g/10 min, the seals may not be suitable for high-speed molding. On the other hand, when the MFR exceeds 5.0 g/10 min, the bonding strength between the male seal 141 and the belt-shaped male base element 151 and between the female seal 142 and the belt-shaped female base element 152 may be decreased and bondability between the seals and the polypropylene sealant layer may be deteriorated.

When the ratio of the metallocene linear low density polyethylene is less than 50 mass %, the bondability of the male seal 141 and the female seal 142 in relation to the sealant layer may be deteriorated, so that the male seal 141 and the female seal 142 can be easily separated by hand. On the other hand, when the ratio of the metallocene linear low density polyethylene exceeds 99 mass %, moldability during extrusion may be deteriorated.

The base film (packaging material) of the packaging bag body 20 is a lamination film having a base layer, a sealant layer laminated on the base layer and aluminum foil (intermediate layer) provided between the base layer and the sealant layer.

Preferable examples of the material of the base layer include OPP (biaxial oriented polypropylene film), biaxially oriented polyester film such as biaxial oriented polyethylene terephthalate (PET) film and polyethylene naphthalate (PEN) film, and biaxially oriented polyamide film such as nylon 6, nylon 66 and poly-meta-xylylene adipamide 6 (MXD6). In addition, various engineering plastic film may be used as necessary. The above films may be singularly used. Or, alternatively, the above films may be laminated in combination.

Exemplary materials of the intermediate layer include films such as ethylene-vinyl acetate copolymer saponificate (abbreviated as "EVOH" hereinafter), polyvinylidene chloride (abbreviated as "PVDC" hereinafter) and polyacrylonitrile (abbreviated as "PAN" hereinafter), vapor-deposition layer of silica, alumina and aluminum, a coated film of PVDC and the like in addition to aluminum foil.

The chuck-tape packaging bag 30 can be easily manufactured using, for instance, a commercially available zipper-attaching three-side-sealing bag-making machine and the like.

The bonding condition (temperature, pressure and the like) may be suitably determined according to the type of the resin of the film material forming the zipper 1 and the packaging bag body 20, and the like.

Advantage of Exemplary Embodiment

According to the above exemplary embodiment, since the resin forming the engaging portion 10 has a specific range of tensile modulus of elasticity and the resin forming the belt-shaped male base element 151 and the belt-shaped female base element 152 also has a specific range of tensile modulus of elasticity, when the zipper 1 is point-sealed on the packaging bag body 20 including aluminum foil, generation of aluminum crack and pinholes can be prevented. Further, when the zipper 1 is heat-sealed on the packaging bag body 20, the generation of seal wrinkles on the belt-shaped male base element 151 and the belt-shaped female base element 152 and thermal deformation of the engaging portion 10 can be restrained, thus producing the packaging bag 30 having the zipper 1 with excellent engagement strength.

Since the male seal 141 and the female seal 142 contain a specific ratio of metallocene linear low density polyethylene having specific density and melt flow rate, the male and female seals can be favorably heat-sealed on the sealant layer of the packaging bag body 20 to be heat-sealed on the zipper 1 even when the sealant layer is not only made of polyethylene but made of polypropylene.

Further, since the resin of the engaging portion 10 has a specific melting point, the zipper 1 can be adhered on the packaging bag body 20 at a temperature lower than the specific melting point.

Further, with the use of TPO having high melting point (130 to 145 degrees C.) as the modifier, when the zipper 1 is heat-sealed on the packaging bag body 20, thermal deformation of the engaging portion 10 and generation of particles can be prevented. Further, since TPO has a low tensile modulus of elasticity, aluminum crack can be efficiently prevented when the zipper 1 is point-sealed.

Since the belt-shaped male base element 151 and the belt-shaped female base element 152 are made of random polypropylene or a random polypropylene mixed with a modifier such as homo-polypropylene and block polypropylene, when the tensile modulus of elasticity is set higher than the resin forming the engaging portion b 10 by 600 MPa or more, the aluminum crack can be further efficiently prevented.

Since the packaging bag 30 is provided by attaching the zipper 1 to the packaging bag body 20, aluminum crack and pinholes are not caused when the zipper 1 is point-sealed and thermal deformation and generation of seal wrinkles on the engaging portion 10 can be restrained when the zipper is heat-sealed on the packaging bag body 20, thereby providing the packaging bag 30 with excellent appearance.

Modifications of Embodiment

It should be understood that the scope of the invention is not limited to the above exemplary embodiment, but includes modifications, improvements and the like as long as they are compatible with an object of the invention.

For instance, though the male seal 141 to be bonded to the sealant layer of the packaging bag body 20 is provided on the belt-shaped male base element 151 and the female seal 142 to be bonded to the sealant layer of the packaging bag body 20 is provided on the belt-shaped female base element 152 in the above exemplary embodiment, the belt-shaped male base element 151 may be directly attached to the sealant layer of the packaging bag body 20 and the belt-shaped female base element 152 may also be directly attached to the sealant layer of the packaging bag body 20. Further, a seal portion independent of the male seal 141 may be interposed between the belt-shaped male base element 151 and the sealant layer of the packaging bag body 20. Also, a seal portion independent of the female seal 142 may be interposed between the belt-shaped female base element 152 and the sealant layer of the packaging bag body 20. An additional seal may be interposed between the male seal 141 and the sealant layer. Also, an additional seal may be provided between the female seal 142 and the sealant layer.

Though the male seal 141 and the female seal 142 contain 50 mass % to 99 mass % of metallocene linear low density polyethylene of which density is in a range of 850 kg/m$^3$ to 920 kg/m$^3$ and melt flow rage is in a range of 1.0 g/10 min to 5.0 g/10 min in the above exemplary embodiment, only one of the male seal 141 and the female seal 142 may contain the specific ratio of the metallocene linear low density polyethylene having the above specific ranges of density and melt flow rate.

Further, though the density of the resin of the male seal 141 and the female seal 142 is 920 kg/m$^3$ or less in the above exemplary embodiment, the density may be greater than 920 kg/m$^3$ in the invention.

Further, though the melt flow rate of the resin of the male seal 141 and the female seal 142 is 5.0 g/10 min or less in the above exemplary embodiment, the melt flow rate may be greater than 5.0 g/10 min in the invention.

Though the male seal 141 and the female seal 142 contain 50 mass % or more of metallocene linear low density polyethylene in the above exemplary embodiment, the ratio may be less than 50 mass % in the invention.

Though the melting point of the resin of the engaging portion 10 is in a range of 115 degrees C. to 160 degrees C. in the above exemplary embodiment, the melting point of the engaging portion 10 may be lower than 115 degrees C. in the invention. Alternatively, the melting point may be higher than 160 degrees C.

Though the engaging portion 10 is made of random polypropylene containing a modifier in the above exemplary embodiment, the engaging portion 10 may be made of LLDPE in the invention.

In this arrangement, a packaging bag 30 can be provided, in which the aluminum crack and generation of pinholes can be efficiently prevented, seal wrinkles are not generated and the engaging portion 10 is less deformed on account of heat.

Though the packaging bag body 20 has an aluminum foil therein in the above exemplary embodiment, the packaging bag body 20 may not include the aluminum foil therein.

EXAMPLES

More specific explanation of the invention will be given below with reference to examples and comparative examples. However, it should be understood that the scope of the invention is not restricted by the results of the examples.

A zipper (chuck-tape) having the structure shown in FIG. 2 was produced by co-extrusion molding of resins using an extruder. The resins forming the engaging portion, belt-shaped male base element, belt-shaped female base element, male seal and female seal were as mentioned below.

The respective solid properties of the resins were measured as follows. The tensile modulus of elasticity was measured according to JIS K7121. The melting point was measured by a DSC (Differential Scanning Calorimeter), where the maximum melt peak was taken as the melting point. The melt flow rate (MFR) was measured according to JIS K7210 under the test temperature of 190 degrees C. and nominal load of 21.18 N.

Preparation of Zipper

Example 1

A mixture of random polypropylene (tensile modulus of elasticity being 800 MPa; melting point being 133 degrees C.; and ethylene content being 4%) and TPO (tensile modulus of elasticity being 260 MPa; melting point being 141 degrees C.; and ethylene content being 1%) at a ratio of 50:50 was used for the engaging portion. The tensile modulus of elasticity of the mixture was 530 MPa and the melting point of the mixture was 141 degrees C.

A random polypropylene resin (tensile modulus of elasticity being 800 MPa; melting point being 133 degrees C.; and ethylene content being 4%) was used for the belt-shaped male base element and the belt-shaped female base element.

A metallocene linear low density polyethylene resin (melting point being 95 degrees C.; MFR being 3 g/10 min) was used for the male seal and the female seal.

Example 2

In the arrangement of the Example 1, a Mixture of the random polypropylene and the TPO (modifier) at a ratio of 30:70. was used for the engaging portion. The tensile modulus of elasticity of the mixture was 420 MPa and the melting point of the mixture was 141 degrees C.

Example 3

In the arrangement of Example 1, the TPO (tensile modulus of elasticity being 260 MPa; melting point being 141 degrees C.; and ethylene content being 1%) was used for the engaging portion.

A random polypropylene resin (tensile modulus of elasticity being 1100 MPa; melting point being 141 degrees C.; and ethylene content being 2.7%) was used for the belt-shaped male base element and the belt-shaped female base element.

Example 4

In the arrangement of Example 1, a mixture of the random polypropylene (tensile modulus of elasticity being 800 MPa; melting point being 133 degrees C.; and ethylene content being 4%) and a TPO (tensile modulus of elasticity being 50 MPa; and melting point being 135 degrees C.: Tafcelene T5722 manufactured by Sumitomo Chemical Co., Ltd) as a modifier at a ratio of 65:35 was used for the engaging portion. The tensile modulus of elasticity of the mixture was 290 MPa and the melting point of the mixture was 134 degrees C.

Example 5

In the arrangement of Example 1, an LLDPE resin (tensile modulus of elasticity being 120 MPa; melting point being 122 degrees C.) was used for the engaging portion.

A random polypropylene resin (tensile modulus of elasticity being 1100 MPa; melting point being 141 degrees C.; and ethylene content being 2.7%) was used for the belt-shaped male base element and the belt-shaped female base element.

Comparative Example 1

In the arrangement of Example 1, the random polypropylene resin (tensile modulus of elasticity being 800 MPa; melting point being 133 degrees C.; and ethylene content being 4%) was used for the engaging portion. This was equivalent to a zipper tape disclosed in JP-A-2005-329150.

Comparative Example 2

In the arrangement of Example 1, an LLDPE resin (tensile modulus of elasticity being 120 MPa; melting point being 122 degrees C.) was used for the engaging portion.

The LLDPE resin (tensile modulus of elasticity being 120 MPa; and melting point being 122 degrees C.) was used for the belt-shaped male base element and the belt-shaped female base element.

Comparative Example 3

In the arrangement of Example 1, an LLDPE resin (tensile modulus of elasticity being 70 MPa; and melting point being 100 degrees C.) was used for the engaging portion.

Comparative Example 4

In the arrangement of the Example 1, a mixture of the random polypropylene and the TPO (modifier) at a ratio of 30:70 was used for the engaging portion. The tensile modulus of elasticity of the mixture was 420 MPa and the melting point of the mixture was 141 degrees C.

A homo-polypropylene resin (tensile modulus of elasticity being 1800 MPa; and melting point being 164 degrees C.) was used for the belt-shaped male base element and the belt-shaped female base element.

Comparative Example 5

In the arrangement of the Example 1, a mixture of the random polypropylene and the TPO (modifier) at a ratio of 60:40 was used for the engaging portion. The tensile modulus of elasticity of the mixture was 580 MPa and the melting point of the mixture was 141 degrees C.

Arrangement of Base Film Forming the Packaging Bag Body

A base film was prepared by extruding and laminating polyethylene terephthalate (PET) of 12 μm thickness and an aluminum foil of 9 μm thickness onto polyethylene of 20 μm thickness.

Point-Sealing of Zipper on the Base Film

The above-mentioned base film was cut and the zipper was sandwiched between the base films. Then, the zipper was point-sealed to measure a ratio of aluminum crack. The base film and the zipper were sealed under the condition of 160 degrees C. and 3 kgf/cm$^2$ for 0.5 sec for thirty times, during which the number of the aluminum crack was counted to measure the aluminum crack rate.

Evaluation Standard of Aluminum Crack

The aluminum crack rate was evaluated according to the following standard of generation rate.

Generation Rate of Aluminum Crack

A: 0 to 25%

B: 26 to 50%

C: 51% or more

Preparation of Packaging Bag

The zippers obtained according to Examples 1 to 5 and Comparative Examples 1 to 5 were bonded to the base film (described later) and three sides of the base film were bonded using a three-side-sealing bag-making machine to prepare a zipper packaging bag. Incidentally, the three sides were partially bonded by point-sealing.

The seal wrinkles, thermal deformation of the zipper, generation of pinholes and suitability for ultrasonic sealing (generation of particles) were evaluated according to the following standards.

Evaluation Standard of Seal Wrinkles

A: No seal wrinkles

C: Seal wrinkles generated. Bad appearance

Evaluation Standard of Thermal Deformation of Engaging Portion

A: Not thermally deformed

B: Though slightly deformed, engagement was not affected

C: Thermally deformed to loosen engagement

Evaluation Standard of Pinholes

A: No pinhole

C: Pinhole generated

Suitability for Ultrasonic Seal

Independently of the above bag evaluations, the zipper was sealed for one second under sealing pressure of 3 kgf/cm$^2$ with a probe vibrating at 400 W output and 28 kMz which was spaced apart from an anvil by 0.4 mm. Then, the presence of particles around melted and flattened part was visually checked.

Evaluation Standard of Particle Generation

A: No particles

C: Particles generated

Overall Evaluation Standard

AA: All of aluminum crack evaluation, seal wrinkles evaluation, thermal deformation of engaging portion, pinholes evaluation and evaluation of particle generation were A.

BB: At least one of aluminum crack evaluation, seal wrinkles evaluation, thermal deformation of engaging portion, pinholes evaluation and evaluation of particle generation was B while the rest of the test results were A.

CC: At least one of aluminum crack evaluation, seal wrinkles evaluation, thermal deformation of engaging portion, pinholes evaluation and evaluation of particle generation was C while the rest of the test results were A or B.

TABLE 1

| | Aluminum Crack | Seal Wrinkles | Thermal Deformation of Engaging Portion | Pinholes | Generation of Particles | Overall Evaluation |
|---|---|---|---|---|---|---|
| Example 1 | A | A | A | A | A | AA |
| Example 2 | A | A | A | A | A | AA |
| Example 3 | A | A | A | A | A | AA |

TABLE 1-continued

| | Aluminum Crack | Seal Wrinkles | Thermal Deformation of Engaging Portion | Pinholes | Generation of Particles | Overall Evaluation |
|---|---|---|---|---|---|---|
| Example 4 | A | A | A | A | A | AA |
| Example 5 | A | A | B | A | B | BB |
| Comparative Example 1 | C | A | A | A | A | CC |
| Comparative Example 2 | B | C | B | A | B | CC |
| Comparative Example 3 | A | A | C | A | B | CC |
| Comparative Example 4 | A | A | A | C | A | CC |
| Comparative Example 5 | C | A | A | A | A | CC |

Evaluation Results

As can be understood from the results shown in Table 1, a packaging bag that could prevent aluminum crack and pinhole generation and restrain the generation of seal wrinkles and thermal deformation of engaging portion was obtained in Examples 1 to 5. Especially, a packaging bag having good appearance without thermal deformation and generation of particles could be obtained according to Examples 1 to 4.

On the other hand, since Comparative Example 1 employed random polypropylene resin for the engaging portion, belt-shaped male base element and belt-shaped female base element, aluminum crack was caused. In Comparative Example 2, since the belt-shaped male base element and the belt-shaped female base element were made of LLDPE resin, aluminum crack and seal wrinkles were caused and particles were generated. In Comparative Example 3, since an engaging portion having 70 MPa of tensile modulus of elasticity was employed, the engaging portion was thermally deformed and particles were generated. In Comparative Example 4, since the belt-shaped male base element and belt-shaped female base element having 1.800 MPa of tensile modulus of elasticity were employed, pinholes were generated. In Comparative Example 5, sufficient softening effect by TPO of random polypropylene was not given to the engaging portion, thereby causing aluminum crack.

According to the Examples, since the resin forming the engaging portion had a specific range of tensile modulus of elasticity and the resin contained in the belt-shaped male base element and the belt-shaped female base element also had a specific range of tensile modulus of elasticity, the generation of aluminum crack and pinholes could be prevented and generation of seal wrinkles on the zipper and thermal deformation of the engaging portion could be restrained, thus providing a packaging bag having an engaging portion with excellent engagement strength.

Further, when the belt-shaped male base element and the belt-shaped female base element were provided by a resin using random polypropylene homo-polypropylene, no seal wrinkles were generated.

Further, when the random polypropylene added with TPO, in which polypropylene content is increased, is used as the resin forming the engaging portion, particles were not generated during ultrasonic heating.

The invention claimed is:

1. A zipper packaging bag comprising:

a packaging bag body wherein the packaging bag body comprises an aluminum foil, and a zipper provided substantially along an opening periphery of a packaging bag body, the zipper comprising:

a pair of male member and a female member, the male member and the female member being engageable with each other to form an accommodating space in cooperation with the packaging bag body, the male member comprising: a belt-shaped male base element provided on the packaging bag body adjacent to the accommodating space; and a male engaging portion projecting from the belt-shaped male base element toward the accommodating space, the female member comprising: a belt-shaped female base element located at a position opposed to the belt-shaped male base element; and a female engaging portion projecting from the belt-shaped female base element, the female engaging portion disengageably engaged with the male engaging portion to form an engaging portion, the belt-shaped male base element and the belt-shaped female base element being made of a resin having a tensile modulus of elasticity in a range of 700 MPa to 1600 MPa, and the engaging portion being made of a resin having a tensile modulus of elasticity in a range of 110 MPa to 560 MPa.

2. The zipper packaging bag of claim 1, wherein the belt-shaped male base element and the belt-shaped female base element respectively comprise a seal portion bonded to the packaging bag body, and the seal portion is made of a resin containing metallocene linear low density polyethylene of which density is in a range of 850 kg/m$^3$ to 920 kg/m$^3$ and melt flow rate is in a range of 1.0 g/10 min to 5.0g/10min, the content of the metallocene linear low density polyethylene being in a range from 50 mass % to 99 mass %.

3. The zipper packaging bag of claim 1, wherein the engaging portion is made of a resin having a melting point in a range of 115 degrees C. to 160 degrees C.

4. The zipper packaging bag of claim 1, wherein the engaging portion is made of a resin containing a modifier.

5. The zipper packaging bag of claim 4, wherein the modifier is a polyolefin thermoplastic elastomer.

6. The zipper packaging bag of claim 5, wherein the melting point of the polyolefin thermoplastic elastomer is in a range of 130 degrees C. to 145 degrees C.

7. The zipper packaging bag of claim 5, wherein the belt-shaped male base element and the belt-shaped female base element are made of a resin containing at least one of resins selected from the group consisting of random polypropylene, block polypropylene and homo-polypropylene.

8. The zipper packaging bar of claim 1, wherein the engaging portion is made of a linear low density polyethylene or a low density polyethylene, and the belt-shaped male base element and the belt-shaped female base element are made of a resin containing at least one of resins selected from the group consisting of random polypropylene, block polypropylene and homopolypropylene.

* * * * *